US005664587A

United States Patent [19]

Gebhart

[11] Patent Number: 5,664,587

[45] Date of Patent: Sep. 9, 1997

[54] EXFOLIATION BRUSH

[76] Inventor: Sean T. Gebhart, 4 Chinaberry Pl., Hampton, Va. 23666

[21] Appl. No.: 684,305

[22] Filed: Jul. 18, 1996

[51] Int. Cl.[6] ..... A45D 24/42

[52] U.S. Cl. ..... 132/119; 132/125; 119/628; 15/207.2; 15/246

[58] Field of Search ..... 15/104.001, 104.8, 15/142, 159.1, 160, 186–188, 201, 207.2, 246; 119/626, 628; 132/119, 125

[56] References Cited

U.S. PATENT DOCUMENTS

| | | | |
|---|---|---|---|
| 671,047 | 4/1901 | Fox . | |
| 2,027,884 | 1/1936 | Schwab | 15/186 |
| 2,071,150 | 2/1937 | Wolfe | 132/125 X |
| 2,112,857 | 4/1938 | Matechik | 132/119 |
| 2,827,895 | 3/1958 | Clohecy et al. | 132/125 X |
| 3,053,264 | 9/1962 | Breton | 132/125 X |
| 3,875,951 | 4/1975 | Yang | 132/119 |
| 4,237,822 | 12/1980 | Kaiser, Jr. . | |
| 4,517,703 | 5/1985 | Koke | 15/246 |
| 5,267,528 | 12/1993 | Murieen, Sr. . | |
| 5,297,882 | 3/1994 | Kornides | 401/184 |

FOREIGN PATENT DOCUMENTS

| | | | |
|---|---|---|---|
| 479815 | 1/1952 | Canada | 15/207.2 |

*Primary Examiner*—Mark Spisich

*Attorney, Agent, or Firm*—Wallace J. Nelson

[57] ABSTRACT

A grooming brush for cleansing and stimulating the human scalp or the skin of fur bearing animals wherein contaminants are scraped from the scalp or skin during grooming with the brush. The brush is provided with a plurality of hollow bristles that collect contaminants such as sebum, dead cell tissue, shampoo, conditioner, oils and dirt from the scalps and hair follicles of humans and animals. A compressible spacer is positioned within the brush body to support a rigid plate provided with a plurality of cleaning tines employed to remove the contaminants collected by the hollow bristles. A retainer cap having an opening therein maintains the rigid metal plate, spacer, and brush body into a unitary structure. After a grooming operation, manual pressure is applied through the retaining cap opening to the rigid plate to compress the spacer and force the connected tines thereon through the individual hollow bristles to expel any collected contaminants therefrom. Upon release of the manual pressure, the compressible spacer returns to its original thickness and retracts the metal plate and tines from the hollow bristle openings to ready the brush for a subsequent grooming procedure.

13 Claims, 3 Drawing Sheets

EXFOLIATION BRUSH

FIELD OF THE INVENTION

This invention relates to brushes in general and relates specifically to an exfoliation brush for cleansing the scalp or skin while grooming the human hair, or animal fur.

BACKGROUND OF THE INVENTION

During the normal course of life, the human head develops a build-up of follicle contaminants such as, dandruff, sebum, dead cell tissue, shampoo, conditioner, oils and dirt from the scalp and hair follicles. The skin of fur bearing animals are similarly affected. It has long been recognized that a healthy, clean and well massaged scalp is conducive to the growth and preservation of hair growth. Numerous grooming brushes and combs have been developed for cleaning and grooming the human head, as well as the skin of fur bearing animals.

During cleaning or grooming, the brush bristles gather various follicle contaminants from the skin that must be removed from the brush or comb for further effective use thereof. Some of these prior art devices employ scraping plates to strip the contaminants from the comb teeth or brush bristles, while others depend upon washing of the comb or brushes for removal of the gathered debris. Although the prior art devices agitate or loosen some of the scalp contaminants, and collect an incidental amount of these contaminants on the exterior surfaces of the bristles or tines of the brush or comb, none of these devices serve to actually collect and remove these contaminants from the scalp.

SUMMARY OF THE INVENTION

It is therefore, an object of the present invention to provide an improved brush and grooming device designed to promote cleaning, maintenance, and stimulation of hair follicles.

It is another object of the present invention to provide a hair grooming device that removes and prevents build-up of follicle contaminants such as sebum, dead cell tissue, shampoo, conditioner, oils and dirt from the scalps and hair follicles of humans and animals.

It is a further object of the present invention to provide a grooming device that will internally collect and retain debris from the scalp during use and is provided with cleaning structure for readying the grooming device for subsequent use.

A further object of the present invention is a process of removing contaminants from the scalps of humans and skins of animals while simultaneously stimulating the hair follicles.

According to the present invention, the foregoing and additional objects are attained by providing a hair brush having a molded foraminous brush body and an integrally formed brush handle. A plurality of elongated hollow bristles extend from a surface of the brush body. Each of the hollow bristles is provided with an enlarged head portion at a first end thereof and an open second end spaced therefrom. Each bristle enlarged head portion is positioned on one surface of the molded foraminous brush body with the second end thereof extending through one of the spaced openings provided in the brush body.

A collapsible foam spacer, having a first surface disposed against the foraminous brush body, is disposed in engagement with each of the enlarged head portions of the bristles. A rigid plate is disposed against a second surface of the foam spacer. A plurality of elongated tines extend from the rigid plate, through the foam spacer and, individually, into the elongated hollow bristles. The elongated tines are at least as long as, and preferably slightly longer than, the hollow bristles. The elongated tines are normally retained spaced from the open ends of the hollow bristles by a distance substantially equal to the thickness of the collapsible foam spacer. The outside diameter of each of the elongated tines is equal to, or slightly less than, the inside diameter of each of the elongated hollow bristles to permit unobstructed sliding movement therein.

A retaining cap is disposed over the rigid plate and maintains the rigid plate, foam spacer and foraminous brush body into a unitary structure. The retaining cap is provided with an open peripheral top surface to permit the application of manual pressure to the rigid plate, as desired. Upon application of manual pressure to the rigid plate, the foam spacer is compressed to permit the rigid plate being moved toward the foraminous brush body. This movement of the rigid plate extends the attached elongated tines through the hollow bristles and forces any contaminants collected therein to be expelled from the bristles and prepare them for subsequent use. Upon release of the manual pressure, the foam spacer expands back to original position and forces return of the rigid plate to its original position adjacent the open retainer cap. The return of the rigid plate moves the integral tines thereon to retract from the open ends of the brush bristles.

BRIEF DESCRIPTION OF THE DRAWINGS

A more complete appreciation of the invention and many of the attendant advantages thereof will be more readily apparent as the same becomes more clearly understood in reference to the following drawings wherein.

DETAILED DESCRIPTION

Figure 1:
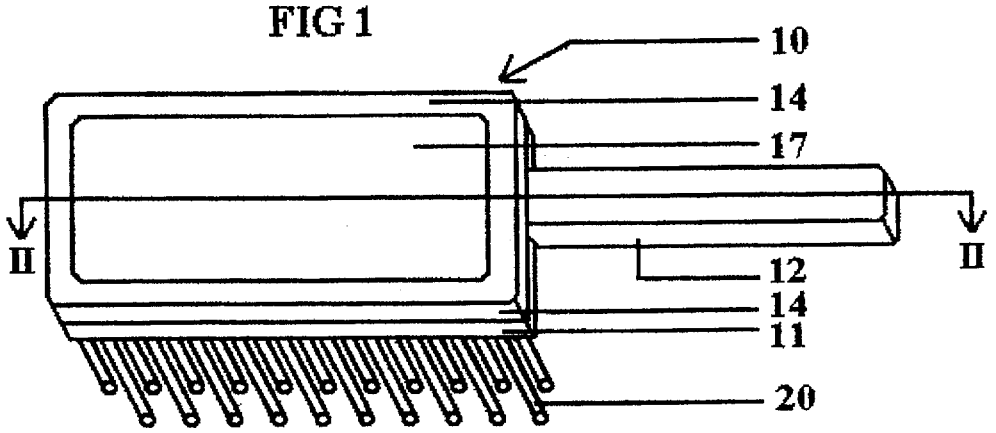
FIG. 1 is a perspective view of the exfoliation grooming brush according to one aspect of the present invention.

Referring now to the drawing and more particularly to FIG. 1, there is shown a hair grooming brush according to the present invention and designated generally by the reference numeral 10. Brush 10 includes a foraminous body 11 and an integral handle 12. An open top, retaining cap 14 is provided on the top surface of brush 10. Retaining cap 14 is provided with a peripheral opening 15 therein to expose a surface of a rigid plate member 17, as will be further explained hereinafter. A plurality of elongated hollow bristles 20 extend from the base of foraminous brush body 11.

Figure 2:
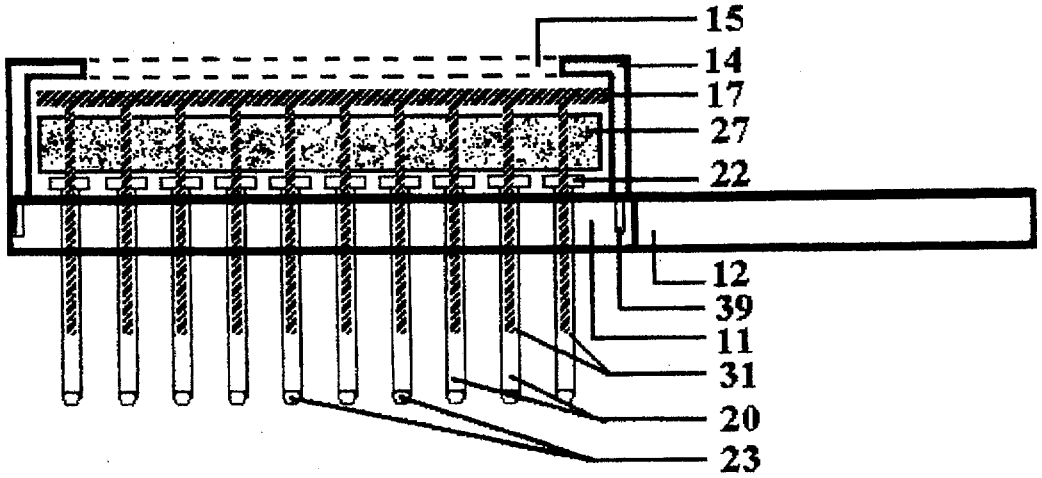
FIG. 2 is a sectional view of the brush shown in FIG. 1 as taken along line II of FIG. 1.

Referring to FIG. 2, it is seen that elongated hollow bristles 20 are each provided with a first end in the form of an open enlarged head portion 22 and a second open end 23 spaced therefrom. The enlarged head portions 22 are disposed on one surface of foraminous brush body 11, with each of the second open ends 23 thereof extending through individual respective spaced openings in foraminous body 11. A foam spacer 27 is provided with a first surface thereof in engagement with the enlarged head portions 22 and one surface of the foraminous brush body 11.

Rigid plate 17 is positioned in engagement with a second surface of the foam spacer 27. A plurality of flexible tines 31 are secured to a first surface of rigid plate 17 and extend through foam spacer 27 and enlarged heads 22 of the individual hollow bristles 20. Flexible tines 31 each have a length at least as long as the hollow bristles 20. As shown in FIG. 2, the free ends of tines 31 are normally maintained spaced from the open ends 23 of bristles by a distance substantially equal to the thickness of foam spacer 27. Flexible tines 31 are provided with an outside diameter the same as, or slightly less than, the inside diameter of hollow bristles 20 to permit easy relative sliding movement therein, as will be further explained hereinafter.

Retaining cap 14 is force fitted over rigid plate 17 and foam spacer 27, via projections 39 for connection with foraminous body 11 to retain the component parts of brush 10 in position, as will be further explained hereinafter.

Figure 3:
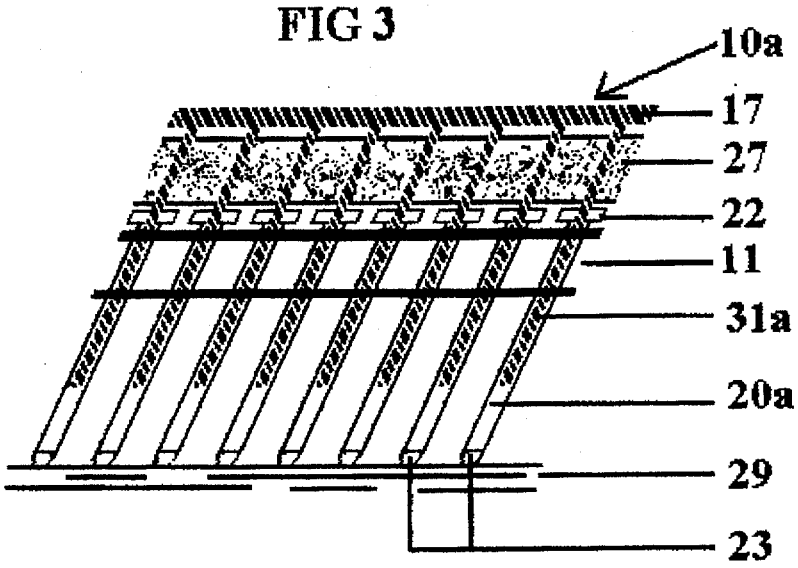
FIG. 3 is a partial sectional view, similar to FIG. 2, illustrating a modification of the positioning of the brush bristles of the present invention.
Figure 4:
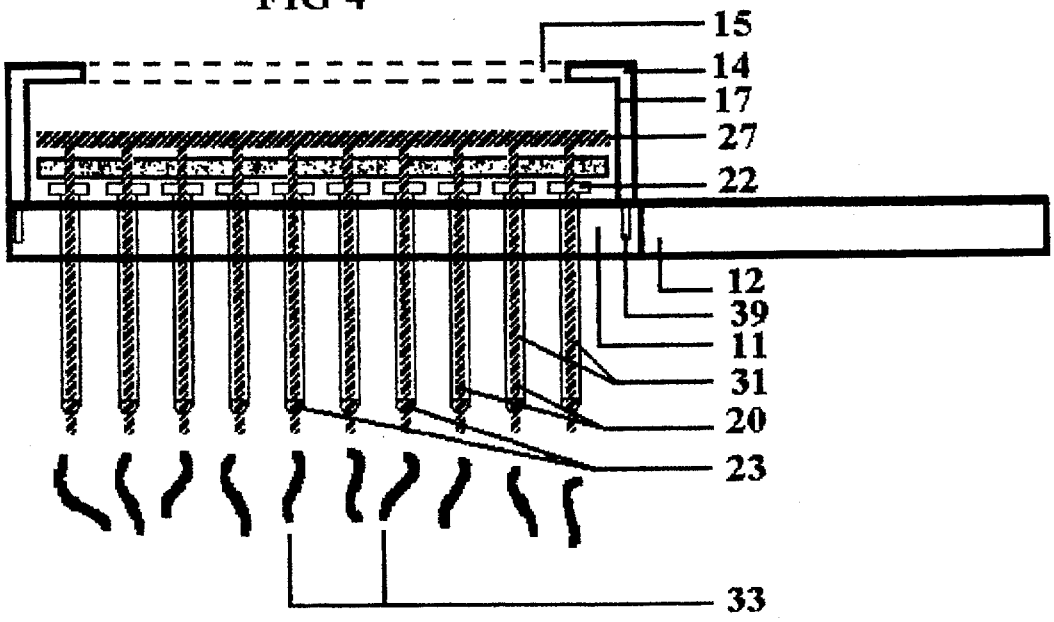
FIG. 4 is a sectional view similar to FIG. 2 and showing the operation of the present invention when expelling debris collected by the hollow bristles of the brush.

An alternate arrangement for the hollow bristles and flexible cleaning tines therefor is shown in FIG. 3. In the embodiment illustrated in FIGS. 1 and 2, the hollow bristles 20 and cleaning tines 31 are mounted substantially perpendicular to the brush body 11. As illustrated in FIG. 3, the angular relationship of hollow bristles 20*a* and cleaning tines 31 a therefor may be at an angle other than ninety degrees without altering the operation or scope of the invention. As shown, the open ends 23 of bristles 20*a* engage the human scalp 29 for collection and removal of contaminants therefrom.

Figure 5:
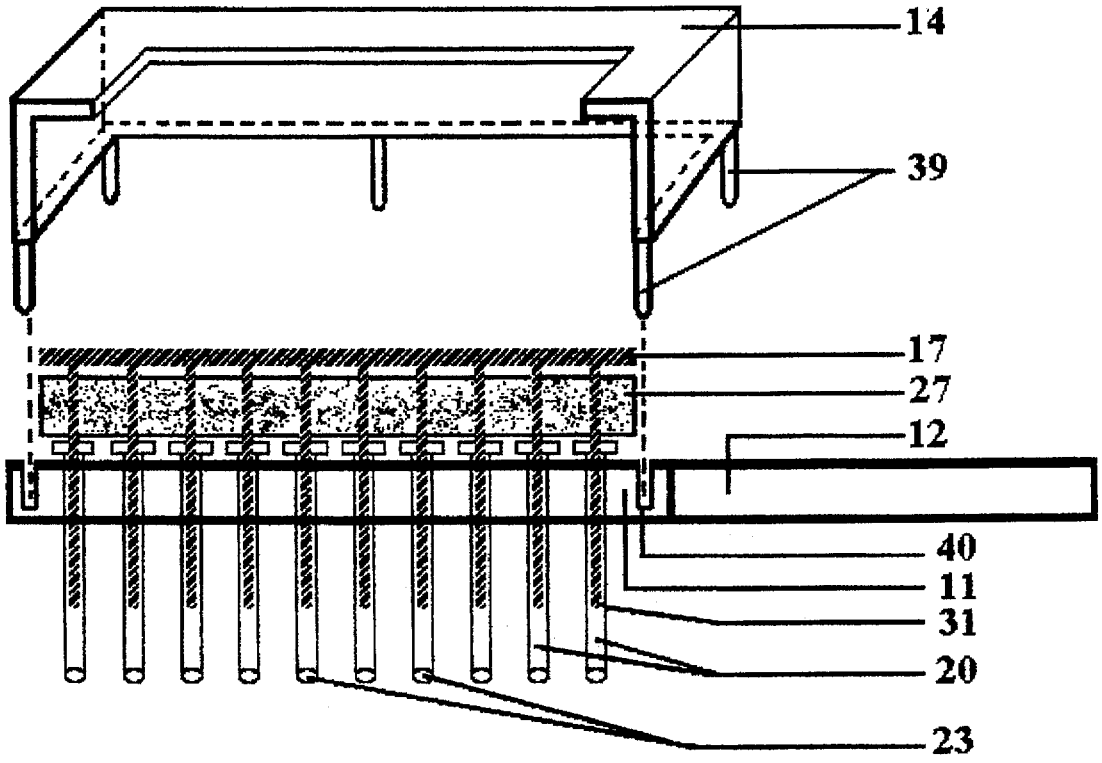
FIG. 5 is a part sectional, part exploded, view similar to FIG. 2 and illustrating the connection structure for assembly of the retaining cap.

Referring now more particularly to FIG. 5, retaining cap 14 is provided with a plurality of spaced depending projections 39 at the base thereof. Projections 39 are inserted into an equal number of bores 40 in brush body 11 and force fitted therein to retain rigid plate 17 and foam spacer 27 in position on brush body 11, in a conventional manner.

In operation, brush 10 (and brush 10*a*, FIG. 3) is employed to groom the hair and, while doing so, collects contaminants from the scalp or skin through the individual open ends 23 of hollow bristles 20. After use, rigid plate 17 is manually depressed against the force of foam spacer 27 to force flexible tines 31 through the open ends 23 of hollow bristles 20 and expel all contaminants 33 collected therein during brush use. Upon release of the manual pressure, foam spacer 27 expands to return rigid plate and the attached flexible tines 31 back to original position, leaving open ends 23. The expelled debris 33 is discarded and disposed of in a conventional manner.

In construction of a specific embodiment of the present invention, brush body 11 and handle 12 is molded from a suitable plastic material, such as polyvinylchloride (PVC), with the holes and bores therein being formed, as made. Alternately, brush body 11 may be cast or machined from any other suitable plastic or metal material with the holes being formed as made, or bored therein afterwards. The individual hollow bristles 20 were cut from 19 gauge hypodermic tubing material (surgical steel) with stainless steel washers bonded thereto to form enlarged heads 22.

The hollow bristles were inserted in a "floating" fashion into the individual holes in brush body 11. This floating, or non-fixed condition, permits the individual bristles 20 to slidably move against the pressure of foam spacer 27, according to the contour of the head during brush use. Alternately, the enlarged heads may be bonded to brush body 11 to prevent slidable movement thereof. In a specific embodiment, hollow bristles 20 had a 2 mm diameter, 0.5 inch length and a 1.66 mm bore. In this embodiment, brush 10 consisted of 60 bristles spaced 0.5 inch apart in staggered rows, and mounted perpendicular with the face of brush body 11. Alternately, the number of hollow bristles 20 may exceed sixty and could be one hundred or more. Also, the hollow bristles 20 may be mounted at an angular relationship (up to 45 degrees) relative to the flat brush body 11 (FIG. 3). This angular positioning may be formed in a forward, aft, port or starboard direction relative to the brush handle, or any combination thereof, as so desired.

In this specific embodiment, the flexible cleaning tines 31 were formed of surgical steel wire having a 0.75 inch length×1.66 mm diameter, (STYLETE cleaning wire) and bonded to rigid metal plate 17 in a conventional manner. Flexible cleaning tines 31 may also be formed of any other suitable flexible metal or plastic material having sufficient rigidity for the purposes intended.

Rigid plate 17 is formed of suitable conventional stainless steel plate. Retaining cap 14 is formed of a suitable plastic (PVC, or the like) and is press fitted over metal plate 17 and foam spacer 27 to snap lock projections 39 thereon into bores 40 formed in body 11.

Flexible tines 31 extend through the 0.5 inch foam spacer 27 and into hollow bristles 20 for approximately 0.25 inch. When the clean out rigid plate 17 is depressed, the cleaning wires will extend completely through the hollow bristles and eject any debris contained therein. When the clean out rigid plate is released, the flexible solid wire tines 31 will retract back into the hollow bristles 20, leaving a clean bore of approximately 0.25 inch in length. Foam spacer 27 is formed of suitable foam rubber that is readily compressible but returns to its original shape and dimensions when the compressing force is removed.

Although the invention has been described relative to specific embodiments thereof, it is not so limited and there are numerous variations and modifications thereof that will be readily apparent to those skilled in the art in the light of the above teachings.

For example, where specific metals and plastics are mentioned, it is to be understood that the substitution of metal for plastic, and vice versa, as well as the use of composites, for the various components is considered within the scope of the invention. Also, dimensions for the brush, bristles and cleaning tines are given by way of example and the number and dimensions of the bristles and cleaning times described herein are to be considered as mere examples of the specific embodiments, and are not limiting factors of the invention. Also, the specific attachment for retaining cap 14 onto brush body 11, as described for the specific example hereinabove, is also to be considered as exemplary only and other attachment structure may be employed to attain this objective without departing from the spirit and scope of the invention.

It is therefore to be understood that, within the scope of the appended claims, the invention may be practiced other than as specifically described herein.

What is claimed as new and desired to be secured by Letters Patent of the United States is:

1. An exfoliation brush comprising:

a foraminous brush body having an integral handle;

a plurality of elongated hollow bristles extending from said foraminous brush body;

each of said plurality of elongated hollow bristles having a first end formed of an open enlarged head portion and a second open end;

each said open enlarged head portion of each of said plurality of elongated hollow bristles being disposed against one surface of said foraminous brush body and said second open end of each said bristle extending through an opening within said foraminous brush body;

a compressible foam spacer having a first surface disposed against said foraminous brush body and in engagement with each said enlarged head portion of each said bristle;

a rigid plate disposed against a second surface of said foam spacer;

a plurality of elongated flexible tines extending from said rigid plate;

each of said plurality of elongated flexible tines having a first end secured to said rigid plate and a second end extending through said foam spacer;

each said second end of each of said plurality of flexible tines being disposed within one of said plurality of hollow bristles;

said foam spacer serving to normally maintain said second end of each of said plurality of flexible tines spaced from said second open end of said hollow bristles;

a retaining cap disposed on said brush body to maintain said rigid plate, and said foam spacer in position on said foraminous brush body;

means for securing said retaining cap to said brush body to provide a unitary structure for said rigid plate, said foam spacer and said foraminous brush body;

said retaining cap having an opening therein to permit manual pressure to be applied to said rigid plate, whereby upon the application of manual pressure to said rigid plate, said foam spacer will be compressed and cause each of said plurality of flexible tines to extend through a respective elongated hollow bristle toward said second open end thereof to effect forcible removal of any follicle contaminants contained therein after brush use.

2. The exfoliation brush of claim 1 wherein each of said plurality of elongated hollow bristles is formed of surgical steel tubing.

3. The exfoliation brush of claim 2 wherein each of said flexible tines are of essentially the same external diameter as the internal diameter of said elongated hollow bristles.

4. The exfoliation brush of claim 2 wherein each of said flexible tines are provided with a length at least equal to that of each of said elongated hollow bristles.

5. The exfoliation brush of claim 1 wherein said rigid plate is a stainless steel plate.

6. The exfoliation brush of claim 1 wherein said compressible foam spacer is a foam rubber spacer.

7. The exfoliation brush of claim 1 wherein said means for securing said retaining cap to said brush body includes a plurality of projections integral with and extending from said retaining cap and an equal number of bores formed in said foraminous brush body for forcibly receiving and retaining each of said projections therein.

8. An exfoliation brush for grooming the human scalp and animal fur comprising;

a brush body having an integral handle;

a plurality of spaced, elongated, hollow bristles extending from said brush body;

said plurality of elongated hollow bristles serving to collect and remove contaminants from the human scalp or animal skin during a grooming procedure using said brush;

means for removing any collected contaminants from the hollow bristles after a grooming procedure and ready the brush for subsequent grooming use;

said brush body being a foraminous structure and each of said plurality of spaced, elongated hollow bristles extending completely through said foraminous structure; and wherein each of said elongated hollow bristles is provided with a first end having an enlarged head portion disposed against a surface of said foraminous brush body and a second open end extending through and spaced from said foraminous brush body.

9. The exfoliation brush of claim 8 including a foam spacer having a first and a second surface and wherein said first surface is disposed against said foraminous brush body and in engagement with each of said enlarged head portions of said hollow bristles.

10. The exfoliation brush of claim 9 wherein said foam spacer is formed of collapsible foam rubber.

11. The exfoliation brush of claim 9 including a rigid plate disposed against said second surface of said foam spacer;

said rigid plate supporting a plurality of spaced, elongated flexible tines;

each one of said plurality of spaced, elongated flexible tines having a first end secured to said rigid plate and a second end extending through said foam spacer;

each said second end of each of said plurality of flexible tines being disposed within one of said plurality of hollow bristles; whereby said foam spacer serves to normally maintain said second end of each of said plurality of flexible tines spaced from said second open end of said hollow bristles.

12. The exfoliation brush of claim 11 including a retaining cap disposed on said brush body to maintain said rigid plate, and said foam spacer in position on said foraminous brush body; and means for securing said retaining cap to said foraminous brush body to provide a unitary structure for said rigid plate, said foam spacer and said foraminous brush body.

13. The exfoliation brush of claim 12 wherein said retaining cap is provided with an opening therein to expose a surface of said rigid plate and permit manual pressure to be applied to said rigid plate, whereby upon the application of manual pressure to said rigid plate, said foam spacer will be compressed and cause each of said plurality of flexible tines to extend through a respective elongated hollow bristle toward said second open end thereof to effect forcible removal of any follicle contaminants contained therein after brush use; and upon removal of the manual pressure, said foam spacer will return to its expanded state and place said individual tines again spaced from the open end of said hollow bristles and place the brush again in a grooming mode.

* * * * *